US012331945B2

(12) United States Patent
Sathyamurthi et al.

(10) Patent No.: US 12,331,945 B2
(45) Date of Patent: Jun. 17, 2025

(54) LEAK SENSORS FOR A HVAC SYSTEM TO DETECT FUEL LEAKS AND METHODS OF OPERATION

(71) Applicant: Lennox Industries Inc., Richardson, TX (US)

(72) Inventors: Vijay Kumar Sathyamurthi, Frisco, TX (US); Joe R. Powell, Rockwall, TX (US); Darko Hadzidedic, Plano, TX (US); Ajith Kumar Cherumani, Dallas, TX (US)

(73) Assignee: Lennox Industries Inc., Richardson, TX (US)

( * ) Notice: Subject to any disclaimer, the term of this patent is extended or adjusted under 35 U.S.C. 154(b) by 286 days.

(21) Appl. No.: 18/185,715

(22) Filed: Mar. 17, 2023

(65) Prior Publication Data

US 2024/0310065 A1 Sep. 19, 2024

(51) Int. Cl.

| | |
|---|---|
| ***F24F 11/32*** | (2018.01) |
| ***F24F 11/52*** | (2018.01) |
| ***F24F 11/77*** | (2018.01) |
| ***F24F 11/80*** | (2018.01) |
| *F24F 110/65* | (2018.01) |

(52) U.S. Cl.

CPC ..... *F24F 11/32* (2018.01); *F24F 11/52* (2018.01); *F24F 11/77* (2018.01); *F24F 11/80* (2018.01); *F24F 2110/65* (2018.01); *F24F 2221/34* (2013.01)

(58) Field of Classification Search

CPC .. F24F 11/32; F24F 11/36; F24F 11/77; F24F 11/80; F24F 11/52; F24F 2110/65; F24F 2221/34

See application file for complete search history.

(56) References Cited

U.S. PATENT DOCUMENTS

| | | | | |
|---|---|---|---|---|
| 11,506,563 | B1 * | 11/2022 | Kraft | G01M 3/2807 |
| 2018/0094844 | A1 * | 4/2018 | Suzuki | F25B 13/00 |
| 2022/0074364 | A1 * | 3/2022 | Miura | F02M 25/0836 |
| 2022/0243940 | A1 * | 8/2022 | Notaro | F24F 11/36 |

* cited by examiner

*Primary Examiner* — Nelson J Nieves

(74) *Attorney, Agent, or Firm* — Baker Botts L.L.P.

(57) ABSTRACT

A method of operating a HVAC system is provided. The method includes transferring heat between airflow and a heating element in the duct system. The heating element is configured to receive a fuel and ignite the fuel to heat the heating element. The method includes measuring a change in at least one gas property value of the airflow in the duct system using a leak detection sensor, where the change in the at least one gas property value is indicative of a gas leaked into the duct system. The method includes determining a concentration of the leaked gas based at least in part upon the change in the at least one gas property value and determining that the concentration as measured by the leak detection sensor has a negative value, where the negative value is indicative of the leaked gas comprising fuel.

20 Claims, 3 Drawing Sheets

LEAK SENSORS FOR A HVAC SYSTEM TO DETECT FUEL LEAKS AND METHODS OF OPERATION

TECHNICAL FIELD

This disclosure relates generally to heating, ventilation, and air conditioning (HVAC) systems. More particularly, this disclosure relates to leak sensors for a HVAC system to detect fuel leaks and methods of operation.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY OF THE DISCLOSURE

Regulations in the HVAC industry are pushing manufacturers to transition away from traditional refrigerants towards low global warming potential (GWP) refrigerants, particularly mildly flammable (A2L) refrigerants. To accommodate for the changes, manufacturers may need to design HVAC systems, including evaporator coils, to be optimized specific to the A2L refrigerants (e.g., R-32 and/or R-454B). Particularly, each evaporator coil may need at least one sensor configured to sense the mildly flammable A2L refrigerant in the event of a leak. Some sensors may sense mildly flammable A2L refrigerants by measuring a change in one or more gas property values (e.g., speed of sound or thermal conductivity) to determine a concentration of the refrigerant leaked in a portion of the HVAC system. During operation, if the concentration of the refrigerant exceeds a threshold concentration, which is typically defined as a threshold percentage of the lower flammability limit (LFL) of the refrigerant (e.g., 25% of the LFL of the refrigerant or lower), then the HVAC system initiates a mitigation mode, where a blower or fan dilutes and removes the refrigerant from the HVAC system. Surprisingly, it was found that sensors configured to sense mildly flammable A2L refrigerants may also be used to detect fuel leaks within the HVAC system, which provides additional safety for HVAC units with heating elements (e.g., furnaces). That is, it was surprisingly found that the presence of a fuel leak (e.g., natural gas) causes the concentration of the gas leak as measured by these sensors to have a negative value. Accordingly, certain aspects of the present disclosure provide systems and methods for mitigating fuel leaks within the HVAC system following detection of the negative concentration values.

In one embodiment, the present disclosure provides a heating, ventilation, and air conditioning (HVAC) system configured to regulate a temperature of a space. The HVAC system comprises an indoor coil positioned in a duct system, where the indoor coil comprises a refrigerant. The HVAC system further comprises a blower positioned in the duct system, where the blower is configured to move airflow across the indoor coil and out of the duct system. The HVAC system further comprises a heating element positioned in the duct system, where the blower is further configured to move the airflow across the heating element to heat the airflow in the duct system, where the heating element is configured to receive a fuel from a fuel source, and where the heating element is configured to ignite the fuel to heat the heating element. The HVAC system further comprises a leak detection sensor configured to measure at least one gas property value of the airflow in the duct system, and a processor communicatively coupled to the leak detection sensor and the blower. The processor is configured to measure a change in at least one gas property value of the airflow in the duct system using the leak detection sensor, where the change in the at least one gas property value is indicative of a gas leaked into the duct system. The processor is further configured to determine a concentration of the leaked gas based at least in part upon the change in the at least one gas property value, and to determine that the concentration as measured by the leak detection sensor has a negative value, where the negative value is indicative of the leaked gas comprising fuel from the heating element. After determining that the concentration of the leaked gas has the negative value, the processor is further configured to turn off the heating element and initiate the blower to move the airflow through the duct system for a duration to dilute or reduce an amount the leaked gas in the duct system.

Certain embodiments of the present disclosure may include some, or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
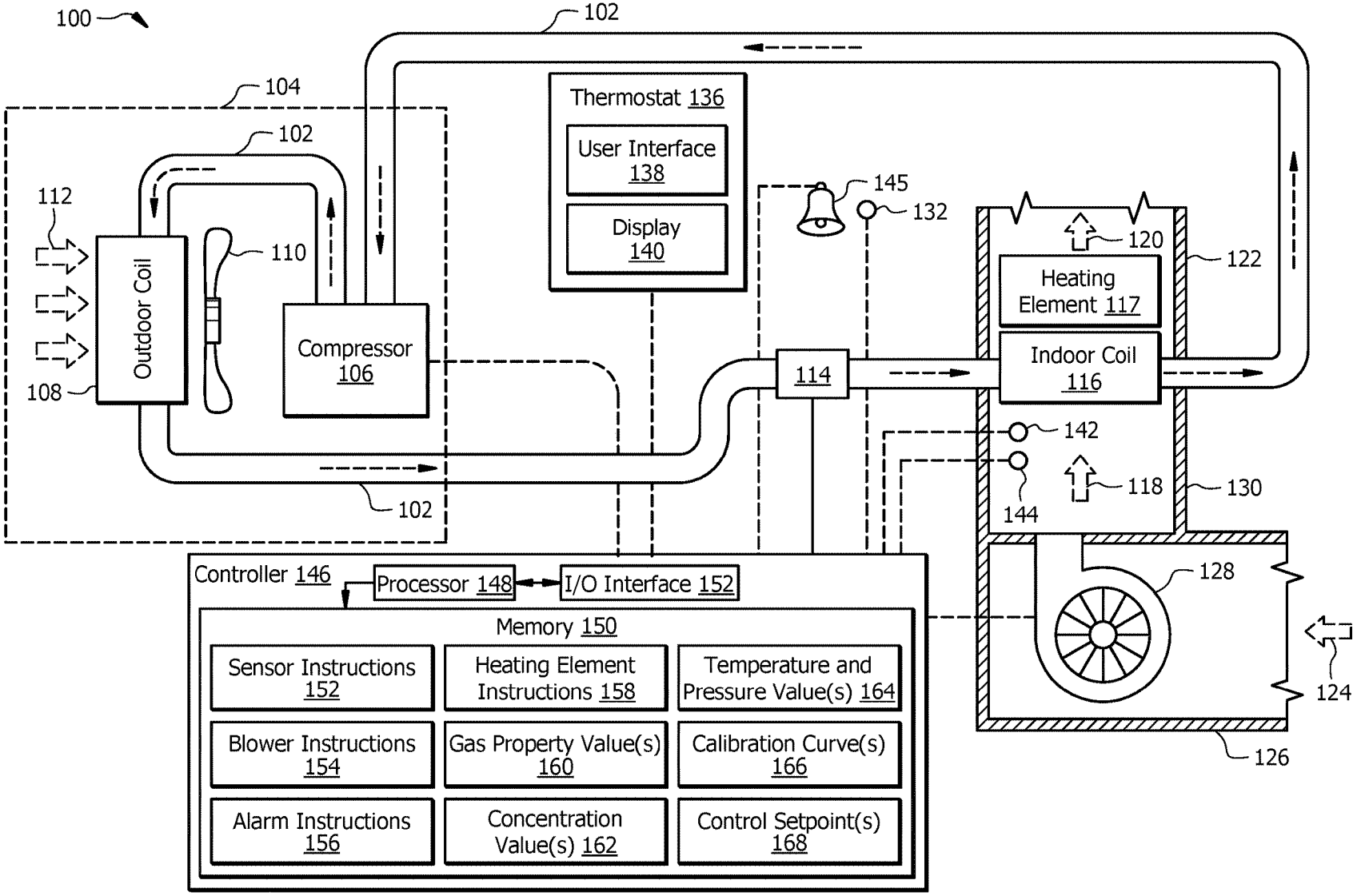
FIG. 1 is a diagram of an HVAC system configured to detect a fuel leak according to some embodiments of the present disclosure.

Embodiments of the present disclosure and its advantages are best understood by referring to FIGS. 1 through 4 of the drawings, like numerals being used for like and corresponding parts of the various drawings.

Regulations in the HVAC industry are pushing manufacturers to transition away from traditional refrigerants towards low global warming potential (GWP) refrigerants, particularly mildly flammable (A2L) refrigerants. To accommodate for the changes, manufacturers may need to design HVAC systems, including indoor coils, to be optimized specific to the A2L refrigerants (e.g., R-32 and/or R-454B). Particularly, each indoor coil may need at least one sensor configured to sense the mildly flammable A2L refrigerant. Some sensors may sense mildly flammable A2L refrigerants by measuring a change in one or more gas property value (e.g., speed of sound or thermal conductivity) to determine a concentration of the refrigerant in a portion of the HVAC system.

For example, a speed of sound sensor may include a transmitter that emits a sonic signal to a receiver at a known distance. The speed of sound sensor calculates a travel time of the sonic signal between the transmitter and the receiver in the gas mixture to determine the speed of sound (e.g., acoustic velocity) of the sonic signal through the gas mixture. The travel time of the sonic signal depends on the density of the gas mixture. Accordingly, speed of sound sensors in the HVAC system can detect gas that leaks into surrounding air because the gas leak will change the density of the air-gas mixture. The change in density will in turn change the travel time of the sonic signal through the air-gas mixture. The speed of sound sensor can measure the change in the speed of sound through the air-gas mixture and compare the measured value to a calibration curve to generate a concentration value of the gas leak. Calibration curves can be constructed using known concentrations of the refrigerant(s) for the HVAC system.

A thermal conductivity sensor may include an electrically heated filament in a detector body. When a gas enters the detector body the filament heats up and a resistance is measured. For example, the filament may be arranged in a Wheatstone bridge circuit so that the presence of the gas in the detector body produces a measurable resistance. Gas containing the leak will result in a change in the resistance measured by the filament. The thermal conductivity sensor can measure the change in the resistance The thermal conductivity sensor can measure the change in resistance and compare the measured value to a calibration curve to generate a concentration value of the gas leak. In some embodiments, the thermal conductivity sensor measures the change in the resistance relative to a reference gas (e.g., nitrogen or air) in a sealed reference detection chamber.

As noted above, HVAC systems operating with mildly flammable A2L refrigerants will include sensors to detect the presence of refrigerant leaks. During operation of the HVAC system, if the concentration of the refrigerant exceeds a threshold concentration, which is typically defined as a threshold percentage of the lower flammability limit (LFL) of the refrigerant (e.g., 25% of the LFL of the refrigerant or lower), then the HVAC system initiates a mitigation mode, where a blower or fan removes the refrigerant from the HVAC system. Surprisingly, it was found that sensors configured to sense mildly flammable A2L refrigerants may also be used to detect fuel leaks within the HVAC system, which provides additional safety for HVAC units with heating elements (e.g., furnaces). That is, it was surprisingly found that the presence of a fuel leak (e.g., natural gas) causes the concentration of the leaked gas as measured by these sensors to have a negative value, whereas the presence of a refrigerant leak causes the concentration to have a positive value. This differential signal can be leveraged to distinguish between a fuel leak and refrigerant leak. Accordingly, certain aspects of the present disclose provide systems and methods for mitigating fuel leaks within the HVAC system following detection of the negative concentration values. The provided HVAC systems, in one embodiment, offer advantages in that the provided sensors may detect the presence of both leaked refrigerant and fuel leaks in a single sensor.

HVAC System

FIG. 1 shows an example HVAC system 100 according to an embodiment of the present disclosure. The HVAC system 100 conditions air for delivery to a conditioned space (e.g., all or a portion of a room, a house, an office building, a warehouse, or the like). In some embodiments, the HVAC system 100 is a rooftop unit (RTU) that is positioned on the roof of a building, and the conditioned air is delivered into the interior of the building. In other embodiments, portion(s) of the system 100 may be located within the building and portion(s) outside the building. The HVAC system 100 may be configured as shown in FIG. 1 or in any other suitable configuration. For example, the HVAC system 100 may include additional components or may omit one or more components shown in FIG. 1.

The HVAC system 100 includes a working fluid conduit 102, at least one condensing unit 104, an expansion valve 114, an indoor coil 116, a heating element 117, a blower 128, a room temperature sensor 132, one or more thermostat 136, a leak detection sensor 142, one or more additional sensor 144, and a controller 146. The controller 146 is generally configured to detect gas leaks in the HVAC system 100 using the leak detection sensor 142 and/or one or more additional sensors 144, which are configured to measure changes in gas property values 160 (e.g., speed of sound, thermal conductivity) of airflow surrounding the indoor coil 116 to determine a concentration 162 of the leaked gas. In some cases, once the concentration 162 has reached a control setpoint 168, the controller 146 initiates the HVAC system 100 to operate in a mitigation mode, where the heater 117 is turned off, and the blower 128 moves airflow across the indoor coil 116 and the heating element 117 for a duration of time to reduce an amount of leaked gas in the HVAC system 100.

The working fluid conduit 102 facilitates the movement of a working fluid (e.g., one or more refrigerants) through a cooling cycle such that the working fluid flows as illustrated by the dashed arrows in FIG. 1. The working fluid may be any acceptable working fluid including, but not limited to, fluorocarbons (e.g., chlorofluorocarbons), ammonia, non-halogenated hydrocarbons (e.g., propane), or hydrofluorocarbons (e.g., R-410A). In some embodiments, the working fluid comprises a mildly flammable A2L refrigerant. As used herein, the term "mildly flammable A2L refrigerant" may be defined in one embodiment according to ASHRAE Standard 34. In one example, according to the ASHRAE Standard 34, the mildly flammable A2L refrigerant meets all four of the following conditions: (i) exhibits flame propagation when tested at 140° F. (60° C.) and 14.7 psia (101.3 kPa); (ii) has a lower flammability limit (LFL)>0.0062 lb/ft$^3$ (0.10 kg/m$^3$); (iii) has a heat of combustion <8169 Btu/lb (19,000 kJ/kg); and (iv) has a maximum burning velocity of ≤3.9 in/s (10 cm/s) when tested at 73.4° F. (23° C.) and 14.7 psia (101.3 kPa) in dry air. Suitable examples of mildly flammable A2L refrigerants include, but are not limited to, R-32, R-454b, or combinations thereof.

The condensing unit 104 comprises a compressor 106, an outdoor coil 108, and a fan 110. In some embodiments, the condensing unit 104 is an outdoor unit while other components of the HVAC system 100 may be located indoors. The compressor 106 is coupled to the working fluid conduit 102 and compresses (i.e., increases the pressure) of the working fluid. The compressor 106 is in signal communication with the controller 146 using wired and/or wireless connection. The controller 146 provides commands and/or signals to control operation of the compressor 106 and/or receive signals form the compressor 106 corresponding to a status of the compressor 106. The compressor 106 of condensing unit 104 may be a single-speed, variable-speed, or multiple stage compressor. A variable-speed compressor is generally configured to operate at different speeds to increase the pressure of the working fluid to keep the working fluid moving along the working-fluid conduit subsystem 102. In the variable-speed compressor configuration, the speed of compressor 106 can be modified to adjust the cooling capacity of the HVAC system 100. Meanwhile, in the multi-stage compressor configuration, one or more compressors can be turned on or off to adjust the cooling capacity of the HVAC system 100.

The outdoor coil 108 is configured to facilitate movement of the working fluid through the working fluid conduit 102. The outdoor coil 108 is generally located downstream of the compressor 106 and is configured to remove heat from the working fluid. The fan 110 is configured to move air 112 across the outdoor coil 108. For example, the fan 110 may be configured to blow outside air through the outdoor coil 108 to help cool the working fluid flowing therethrough. The fan 110 may be in communication with the controller 146 (e.g., via wired and/or wireless communication) to receive control signals for turning the fan 110 on and off and/or adjusting a speed of the fan 110. The compressed, cooled working fluid flows from the outdoor coil 108 toward the expansion valve 114.

The expansion valve 114 is coupled to the working fluid conduit 102 downstream of the outdoor coil 108 and is configured to remove pressure from the working fluid. In this way, the working fluid is delivered to the indoor coil 116. In general, the expansion valve 114 may be a valve such as an expansion valve or a flow control valve (e.g., a thermostatic expansion valve (TXV)) or any other suitable valve for removing pressure from the working fluid while, optionally, providing control of the rate of flow of the working fluid. The expansion valve 114 may be in communication with the controller 146 (e.g., via wired and/or wireless communication) to receive control signals for opening and/or closing associated valves and/or to provide flow measurement signals corresponding to the rate of working fluid flow through the working fluid conduit 102. The indoor coil 116 is generally any heat exchanger configured to provide heat transfer between air flowing through (or across) the indoor coil 116 (i.e., airflow 118 contacting an outer surface of one or more coils of the indoor coil 116) and working fluid passing through the interior of the indoor coil 116. The indoor coil 116 may include one or more circuits of coils. The indoor coil 116 is fluidically connected to the compressor 106, such that working fluid generally flows from the indoor coil 116 to the condensing unit 104 when the HVAC system 100 is operating to provide cooling. When the HVAC system 100 is configured to operate as a heat pump the indoor coil 116 acts as a condenser to heat the flow of air 120 passing therethrough. When the HVAC system 100 is configured to operating in a cooling mode, the indoor coil 116 acts as an evaporator to cool the flow of air 120 passing therethrough.

A portion of the HVAC system 100 is configured to move airflow 118 provided by the blower 128 across the indoor coil 116 and out of a duct system 122 as conditioned airflow 120. Return air 124, which may be air returning from the building, fresh air from outside, or some combination, is pulled into a return duct 126. A suction side of the blower 128 pulls the return air 124. The blower 128 discharges airflow 118 into a duct 130 such that airflow 118 crosses the indoor coil 116 or heating element 117 to produce conditioned airflow 120. The blower 128 is any mechanism for providing airflow 118 through the HVAC system 100. For example, the blower 128 may be a constant speed or variable speed circulation blower or fan. Examples of a variable speed blower include, but are not limited to, belt-drive blowers controlled by inverters, direct-drive blowers with electronic commuted motors (ECM), or any other suitable type of blower.

The heating element 117 is generally any device for heating the flow of air 118 and providing heated air 120 to the conditioned space, when the HVAC system 100 operates in a heating mode. For example, the heating element 118 may be a furnace. The heating element 117 may be configured to receive a fuel from a fuel source, where the heating element 117 is configured to ignite the fuel to heat the heating element 117. Exemplary fuels include but are not limited to natural gas, propane, oil, or any other combustible compound. In some embodiments, the HVAC system 100 is configured to operate as a heat pump. Generally, when the HVAC system is operating as a heat pump in a heating mode, the flow of refrigerant is reversed, such that the outdoor coil 108 acts an evaporator and the indoor coil 116 acts as a condenser to heat the flow of air 120 passing therethrough. If the HVAC system 100 is configured to operate as a heat pump, the HVAC system 100 may include a reversing valve to reverse the flow of working fluid through the HVAC system 100 during operation in the heating mode and an outdoor expansion device for expanding the working fluid provided to the outdoor coil 108, which acts an evaporator in the heating mode. When the HVAC system 100 is configured to operate as a heat pump, the heating element 117 may provide supplemental and/or backup heating to the flow of air 120. The heating element 117 may be in communication with the controller 146 (e.g., via wired and/or wireless communication) to receive control signals for activating the heating element 117 to heat the flow of air 118, when the HVAC system 100 is operated in a heating mode. Generally, when the HVAC system 100 is operated in a heating mode, the heating element 117 and blower 128 are turned on such that the flow of air 118 is provided across and heated by the heating element 117. When the HVAC system 100 is operated in a cooling mode, the heating element 117 is generally turned off (i.e., such that the flow of air 118 is not heated by heating element 117).

The HVAC system 100 includes a room sensor 132 in signal communication with the controller 146 (e.g., via wired and/or wireless connection). Room sensor 132 is positioned and configured to measure an indoor air temperature. The room sensor 132 may also be configured to measure air humidity and/or any other properties of a conditioned space (e.g., a room of the conditioned space). Room sensor 132 and/or any other sensors may be positioned anywhere within the conditioned space, the HVAC system 100, and/or the surrounding environment.

The thermostat 136 may be located within the conditioned space (e.g., a room or building) serviced by the HVAC system 100. In some embodiments, the controller 146 may be separate from or integrated within the thermostat 136. The thermostat 136 is configured to allow a user to input a desired temperature or baseline setpoint temperature for the conditioned space. In some embodiments, the thermostat 136 includes a user interface 138 and display 140 for displaying information related to the operation and/or status of the HVAC system 100. For example, the user interface 138 may communicate with the display 140 to show operational, diagnostic, and/or status messages and provide a visual interface that allows at least one of an installer, a user, a support entity, and a service provider to perform actions with respect to the HVAC system 100. For example, the user interface 138 may communicate with the display 140 to show messages related to the status and/or operation of the HVAC system 100.

The HVAC system 100 includes at least one leak detection sensor 142 in signal communication with the controller 146 (e.g., via wired and/or wireless connection). The leak detection sensor 142 is positioned in or adjacent to the duct system 122 or the indoor coil 116. The leak detection sensor 142 is configured to measure at least one gas property value of the airflow 118 in the duct system 122. The leak detection sensor 142 is generally configured to sense leaked gas, which may include refrigerant leaked from the indoor coil 116 or fuel leaked from the heating element 117. The leak detection sensor 142 is configured to measure a change in at least one gas property value of the airflow 118 in the duct system 122 to determine a concentration of the leaked gas based at least in part upon the change in the at least one gas property value. In some embodiments, the leak detection sensor 142 is a speed of sound sensor. The speed of sound sensor may include a transmitter configured to emit a sonic signal through the airflow 118 to a receiver at a known distance. The speed of sound sensor measures a travel time of the sonic signal between the transmitter and the receiver as it travels through the airflow 118 to determine a speed of sound (e.g., acoustic velocity) of the sonic signal in the airflow 118. The speed of sound sensor is configured to detect gas that leaks into the airflow 118 because the gas leak will change the density of the airflow 118, which will in turn change the travel time of the sonic signal through the airflow 118. The speed of sound sensor can measure the change in the speed of sound through the airflow 118 that is indicative of the gas leak, and the controller 146 may compare the measured value to a calibration curve 166 to generate a concentration value 162 of the gas leak. The calibration curve 166 can be constructed and stored in the controller 146 by measuring speed of sound values for known concentrations of refrigerants. In some embodiments, the speed of sound sensor takes a baseline measurement when no gas leak is present in the airflow 118 and/or the controller 146 stores a reference speed of sound measurement for air. The change in the speed of sound measurement may be determined by the difference between the measured speed of sound value through the airflow 118 and the baseline measurement, or difference between the measured speed of sound value and the reference speed of sound measurement.

In some embodiments, the leak detection sensor 142 is a thermal conductivity sensor which either detects a change in thermal conductivity due to a gas leak relative to the thermal conductivity of air, or detects the change in in thermal conductivity relative to a reference thermal conductivity of a known reference gas (e.g., nitrogen) in a sealed reference chamber. The thermal conductivity sensor may include an electrically heated filament in a detector body. When airflow 118 enters the detector body the filament heats up and a resistance is measured. For example, the filament may be arranged in a Wheatstone bridge circuit so that the presence of the airflow 118 in the detector body produces a measurable resistance. Airflow 118 containing the gas leak will result in a change in the resistance measured. In some embodiments, the thermal conductivity sensor takes a baseline measurement when no gas leak is present in the airflow 118 and/or the controller 146 stores a reference thermal conductivity measurement for air. The change in the thermal conductivity may be determined by the difference between the measured thermal conductivity value and the baseline measurement, or the difference between the measured thermal conductivity value and the reference thermal conductivity measurement. The thermal conductivity sensor can measure the change in the resistance, and the controller 146 may compare the measured value to a calibration curve 166 to generate a concentration value 162 of the gas leak. The calibration curve 166 can be constructed and stored in the controller 156 by measuring thermal conductivity for known concentrations of refrigerants. The calibration curves can be constructed for a range of temperatures and pressures. Although a single leak detection sensor 142 is illustrated in FIG. 1, it should be appreciated that multiple leak detection sensors 142 may additionally or alternatively be configured at different spatial locations within the duct system 122 to improve detection and/or response to the leaked gas.

In some embodiments, the HVAC system 100 includes at least one sensor 144 positioned in or adjacent to the duct system 122. The at least one sensor 144 may be configured to measure a temperature and/or pressure values 164 of the airflow 118 in the duct system 122. The at least one sensor 144 may be used to measure the temperature and/or pressure values 164 of the airflow 118 in the duct system 122 in addition to the leak detection sensor 142 or as an alternative to the leak detection sensor 142. The sensor 144 is in signal communication with the controller 146 using wired and/or wireless connection. The controller 146 provides commands and/or signals to control operation of the sensor 144 and/or receive signals from the sensor 144. Since the thermal conductivity and the speed of sound within the airflow 118 may take into account temperature and pressure values 164, the controller 146 may receive the temperature and pressure values 164 to determine the concentration values 162. In some embodiments, the at least one sensor 144 includes a temperature sensor, a pressure sensor, or a combination thereof. In other embodiments, the sensor 144 is a dual temperature pressure sensor. The leak detection sensor 142 and the at least one sensor 144 may be positioned anywhere within the duct system 122 and/or the surrounding environment.

The HVAC system 100 includes an alarm 145 in signal communication with the controller 146 (e.g., wired and/or wireless connection). In some embodiments, the alarm 145 is located within the conditioned space (e.g., a room or building) serviced by the HVAC system 100. Although not illustrated in FIG. 1, the alarm 145 may be integrated into the thermostat 136. As will be described in more detail below, after the leak detection sensor 142 senses that leaked gas exceeds a control setpoint 168, the controller 146 is configured to trigger the alarm 145.

The controller 146 is communicatively coupled (e.g., via wired and/or wireless connection) to components in the HVAC system 100 and configured to control their operation. In some embodiments, controller 146 can be one or more controllers associated with one or more components of the HVAC system 100. The controller 146 includes a processor 148, memory 150, and an input/output (I/O) interface 152. The processor 148 comprises one or more processors operably coupled to the memory 150. The processor 148 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 150 and controls the operation of HVAC system 100. The processor 148 may be a programmable logic device, a microcontroller, a microprocessor, or any suitable combination of the preceding. The processor 148 is communicatively coupled to and in signal communication with the memory 150. The one or more processors are configured to process data and may be implemented in hardware or software. For example, the processor 148 may be 8-bit, 16-bit, 32-bit, 64-bit or of any other suitable architecture. The processor 148 may include an arithmetic logic unit (ALU) for performing arithmetic and logic operations, processor registers that supply operands to the ALU and store the results of ALU operations, and a control unit that fetches instructions from memory 150 and executes them by directing the coordinated operations of the ALU, registers, and other components. The processor 148 may include other hardware and software that operates to process information, control the HVAC system 100, and perform any of the functions described herein. The processor 148 is not limited to a single processing device and may encompass multiple processing devices.

The memory 150 includes one or more disks, tape drives, or solid-state drives, and may be used as an over-flow data storage device, to store programs when such programs are selected for execution, and to store instructions and data that are read during program execution. The memory 150 may be volatile or non-volatile and may comprise ROM, RAM, ternary content-addressable memory (TCAM), dynamic random-access memory (DRAM), and static random-access memory (SRAM). The memory 150 is operable to store any suitable set of instructions, logic, rules, and/or code for executing the functions described in this disclosure. For example, the memory 150 may store sensor instructions 152 for operation, blower instructions 154 for operation, alarm instructions 156 for operation, heating element instructions 158 for operation, gas property values 160, concentration values 162, temperature and pressure valves 164, calibration curves 166, and control setpoints 168 and/or operating parameters for components in the system 100.

The I/O interface 152 is configured to communicate data and signals with other devices. For example, the I/O interface 152 may be configured to communicate electrical signals with the other components of the HVAC systems 100. The I/O interface 152 may comprise ports and/or terminals for establishing signal communications between the controller 146 and other devices. The I/O interface 151 may be configured to enable wired and/or wireless communications. Connections between various components of the HVAC system 100 and between components of system 100 may be wired or wireless. For example, conventional cable and contacts may be used to couple the thermostat 136 to the controller 146 and various components of the HVAC system 100, including, the compressor 106, the expansion valve 114, the heating element 117, the blower 128, the leak detection sensor 142, the at least one sensor 144, and the room sensor 132. In some embodiments, a wireless connection is employed to provide at least some of the connections between components of the HVAC system 100. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other.

As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 146 to other components of the HVAC system 100.

Figure 2:
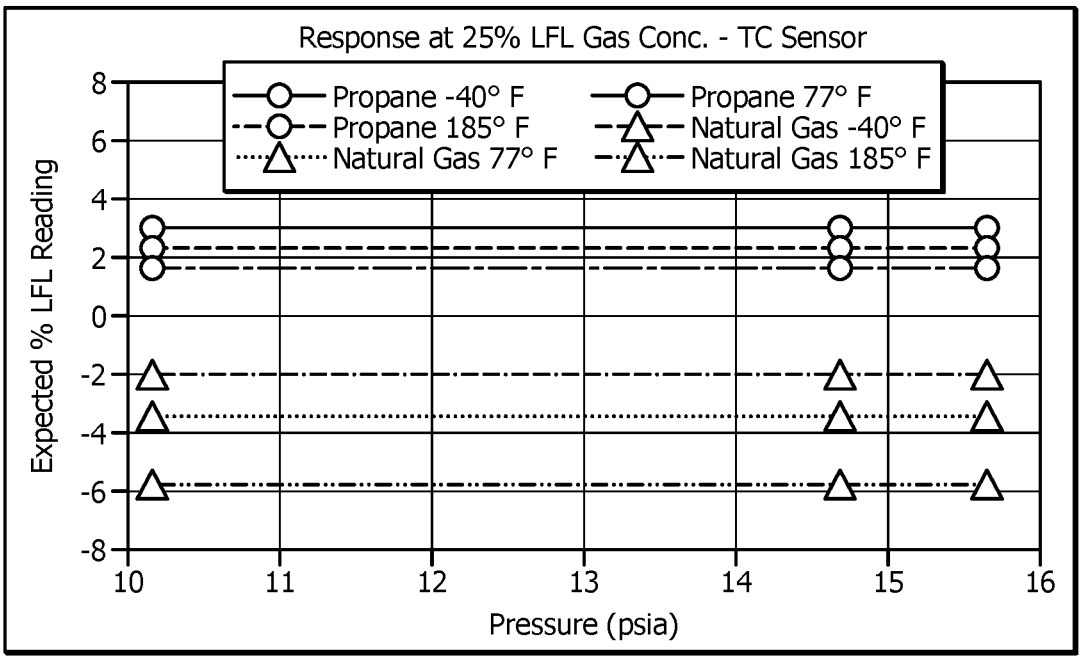
FIG. 2 is a plot illustrating a percentage lower flammability limit reading as measured by a thermal conductivity sensor for a 25% lower flammability limit concentration of natural gas and propane.

In some embodiments, the controller 146 and leak detection sensor 142 are configured to continuously or intermittently monitor for a gas leaked into the duct system 122. For example, the controller 146 is configured to measure a change in at least one gas property value 160 of airflow 118 in the duct system 122 using the leak detection sensor 142, where the change in the at least one gas property value 160 is indicative of a gas leaked into the duct system 122. As described above, the presence of the gas leak in airflow 118 causes the thermal conductivity of the airflow 118 or the speed of sound through airflow 118 to change relative to airflow 118 without the gas leak. The controller 146 is further configured to determine a concentration 162 of the leaked gas based at least in part upon the change in the at least one gas property value 160. For example, the leak detection sensor 142 can measure a change in the thermal conductivity or the speed of sound in the airflow 118 induced by the gas leak, and the controller 146 may compare the measured value to a calibration curve 166 to generate a concentration value 162 of the gas leak. The leak detection sensor 142 is normally configured to monitor for the presence of refrigerant leaks in the HVAC system 100, where the calibration curve(s) 166 includes known concentrations of refrigerants that can be used to determine the concentration of the gas leaks via the changes in the one or more gas property value 160. Surprisingly, it was found that the presence of certain fuel leaks (e.g., natural gas) cause the concentration 162 as measured by the leak detection sensor 142 to have a negative value. Therefore, when the leak detection sensor 142 measures a concentration value 162 with a negative value it is indicative of a fuel leak in the HVAC system 100. For example, FIG. 2 illustrates a plot of a concentration of a leaked gas as measured by a thermal conductivity sensor for a 25% lower flammability limit concentration of natural gas and propane in air as a function of pressure. FIG. 2 shows that the presence of certain fuels, such as natural gas, cause the concentration as measured by the leak detection sensor 142 to have a negative value.

Figure 3:
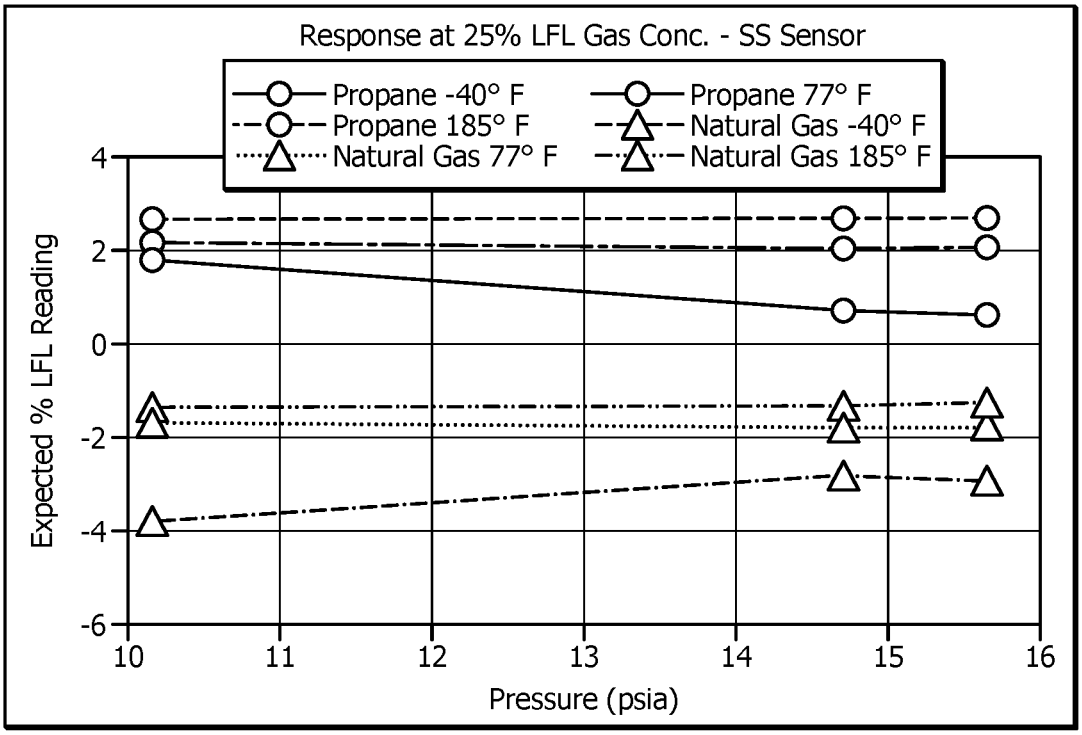
FIG. 3 is a plot illustrating a percentage lower flammability limit reading as measured by a speed of sound sensor for a 25% lower flammability limit concentration of natural gas and propane.

FIG. 3 illustrates a plot of a concentration of a leaked gas as measured by a speed of sound sensor for a 25% lower flammability limit concentration of natural gas and propane in air as a function of pressure. FIG. 3 shows that the presence of certain fuels, such as natural gas, cause the concentration as measured by the leak detection sensor 142 to have a negative value. In this way, the controller 146 is configured to selectively sense the presence of certain fuel leaks, such as natural gas, in the HVAC system 100 and in turn initiate a mitigation response. For example, the controller 146 may be configured to turn off the heating element 117 and initiate the blower to move the airflow 118 through the duct system 122 for a duration to reduce an amount of the leaked gas in the duct system 122. In some embodiments, after determining that the concentration of the leaked gas has a negative value, the controller 146 is configured to trigger the alarm 145.

In some embodiments, the controller 146 is configured to determine a control setpoint 168. The control setpoint 168 may correspond to a maximum allowable concentration of leaked gas in the duct system 122. The control setpoint 168 may depend on the gas property value 160 used by the leak detection sensor 142. For example, the control setpoint 168 when measuring thermal conductivity (e.g., FIG. 2) may be set from −2% to −6% of the lower flammability limit of the leaked gas as measured by the leak detection sensor. Alternatively, the control setpoint 168 when measuring speed of sound (e.g., FIG. 3) may be set from −1.5% to −4% of the lower flammability limit of the leaked gas as measured by the leak detection sensor. After determining that the concentration falls within the control setpoint 168, the controller 146 may be configured to activate the mitigation mode. For example, the controller 146 may turn off the heating element 117 and initiate the blower to move the airflow 118 through the duct system 122 for a duration to reduce the amount of leaked gas in the duct system 122.

Figure 4:
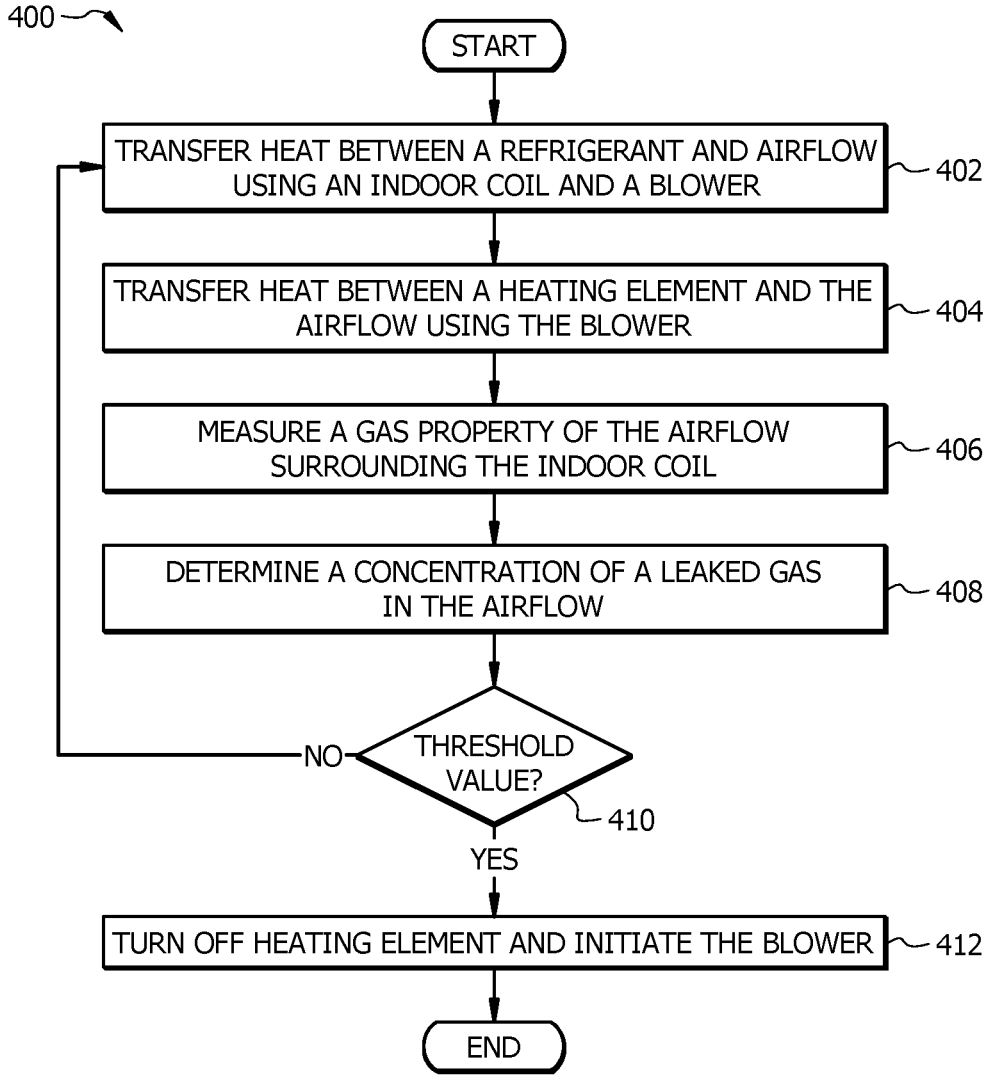
FIG. 4 is a flowchart of an example method of operating the system of FIG. 1.

FIG. 4 is a flowchart of an example method 400 of operating the system 100 of FIG. 1. Method 400 begins at operation 402, which includes transferring heat between airflow 118 in a duct system 122 and a refrigerant in the indoor coil 116, where the blower 128 moves the airflow 118 across the indoor coil 116 to transfer heat therebetween. At operation 404, the method 400 includes transferring heat between the airflow 118 and the heating element 117 in the duct system 122, where the blower 128 moves the airflow 118 across the heating element 117. The heating element 117 is configured to receive a fuel from a fuel source, where the heating element 117 ignites the fuel to heat the heating element 117 and in turn to transfer heat to the airflow 118 passing over the heating element 117. At operation 406, the method 400 includes measuring a change in at least one gas property value 160 of the airflow 118 in the duct system 122 using the leak detection sensor 142, where the change in the at least one gas property value 160 is indicative of a gas leaked into the duct system 122. As described above, the presence of the gas leak in airflow 118 causes the thermal conductivity of the airflow 118 or the speed of sound through airflow 118 to change relative to airflow 118 without the gas leak. At operation 408, the method 400 includes determining a concentration 162 of the leaked gas based at least in part upon the change in the at least one gas property value 160. For example, the leak detection sensor 142 can measure a change in the thermal conductivity or the speed of sound in the airflow 118 induced by the gas leak, and the controller 146 may compare the measured value to a calibration curve 166 to generate a concentration value 162 of the gas leak. The leak detection sensor 142 is normally configured to monitor for the presence of refrigerant leaks in the HVAC system 100, where the calibration curve(s) 166 includes known concentrations of refrigerants that can be used to determine the concentration of the gas leaks via the changes in the one or more gas property value 160. Surprisingly, it was found that the presence of certain fuel leaks (e.g., natural gas) cause the concentration 162 as measured by the leak detection sensor 142 to have a negative value.

At operation 410, the method 400 includes determining whether the concentration 162 of the leaked gas as measured by the leak detection sensor 142 has a negative value, which is indicative of the leaked gas comprising fuel (e.g., natural gas). If the concentration 162 of the leaked gas is not a negative value, the method 400 may re-initiate operations 402-408. If the concentration 162 of the leaked gas is a negative value, the method 400 proceeds to operation 412. At operation 412, the method 400 includes turning off the heating element 117 and initiating the blower to move the airflow 118 through the duct system 122 for a duration of time to reduce an amount of leaked gas in the duct system 122. In some embodiments, after determining that the concentration 162 of the leaked gas as measured by the leak detection sensor 142 is a negative value, the method 400 may include triggering an alarm 145.

In some embodiments, operation 410 may further include comparing the concentration 162 of the leaked gas to a control setpoint 168 for a maximum allowable concentration of leaked gas in the duct system 122. The maximum allowable concentration of the leaked gas is typically defined as a threshold percentage of the lower flammability limit of the leaked gas (e.g., 25% LFL of the leaked gas or lower). In the case where the gas property value 160 used by the leak detection sensor 142 is a speed of sound through the airflow 118, the control setpoint 168 may be set to −1.5% to −4% of the lower flammability limit of the leaked gas as measured by the leak detection sensor 142. As shown in FIG. 3, −1.5% to −4% corresponds to a 25% LFL natural gas concentration in air when measured using the leak detection sensor 142 for the specified temperatures and pressures. In the case where the gas property value 160 used by the leak detection sensor 142 is the thermal conductivity of the airflow 118, the control setpoint 168 may be set to −2% to −6% of the lower flammability limit of the leaked gas as measured by the leak detection sensor 142. As shown in FIG. 2, −2% to −6% corresponds to a 25% LFL natural gas concentration in air when measured using the leak detection sensor 142. If the concentration 162 of the leaked gas falls outside of the control setpoint 168, the method 400 may re-initiate operations 402-408. If the concentration falls within the control setpoint 168, the method may proceed to operation 412.

Modifications, additions, or omissions may be made to the systems and methods described herein without departing from the scope of the disclosure. The systems and methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system configured to regulate a temperature of a space, the HVAC system comprising:

an indoor coil positioned in a duct system, the indoor coil comprising a refrigerant;

a blower positioned in the duct system, the blower configured to move airflow across the indoor coil and out of the duct system;

a heating element positioned in the duct system, wherein the blower is further configured to move the airflow across the heating element to heat the airflow in the duct system, wherein the heating element is configured to receive a fuel from a fuel source, and wherein the heating element is configured to ignite the fuel to heat the heating element;

a leak detection sensor configured to measure at least one gas property value of the airflow in the duct system;

a processor communicatively coupled to the leak detection sensor and the blower, and configured to:

measure a change in at least one gas property value of the airflow in the duct system using the leak detection sensor, wherein the change in the at least one gas property value is indicative of a gas leaked into the duct system;

determine a concentration of the leaked gas based at least in part upon the change in the at least one gas property value;

determine that the concentration as measured by the leak detection sensor has a negative value, wherein the negative value is indicative of the leaked gas comprising fuel, wherein after determining that the concentration of the leaked gas has the negative value, the processor is configured to:

turn off the heating element; and initiate the blower to move the airflow through the duct system for a duration to reduce an amount of the leaked gas in the duct system.

2. The HVAC system of claim 1, wherein the fuel comprises natural gas.

3. The HVAC system of claim 1, wherein the refrigerant comprises an A2L refrigerant.

4. The HVAC system of claim 1, wherein after determining that the concentration of the leaked gas has a negative value, the processor is configured to trigger an alarm.

5. The HVAC system of claim 1, wherein the at least one gas property value is selected from a speed of sound and thermal conductivity.

6. The HVAC system of claim 1, wherein the processor is further configured to:

measure a change in a speed of sound of the airflow in the duct system using the leak detection sensor, wherein the change in the speed of sound of the airflow is indicative of the leaked gas in the duct system;

determine a concentration of the leaked gas based on the change in the speed of sound, wherein the concentration is determined as a percentage of a lower flammability limit of the leaked gas;

compare the concentration to a control setpoint for a maximum allowable concentration of leaked gas in the duct system, wherein the control setpoint is from −1.5% to −4% of the lower flammability limit of the leaked gas as measured by the leak detection sensor, wherein after determining that the concentration falls within the control setpoint, the processor is configured to:

turn off the heating element; and initiate the blower to move the airflow through the duct system for a duration to reduce an amount of the leaked gas in the duct system.

7. The HVAC system of claim 1, wherein the processor is further configured to:

measure a change in a thermal conductivity of the airflow in the duct system using the leak detection sensor, wherein the change in the thermal conductivity of the airflow is indicative of the leaked gas in the duct system;

determine a concentration of the leaked gas based on the change in the speed of sound, wherein the concentration is determined as a percentage of a lower flammability limit of the leaked gas;

compare the concentration to a control setpoint for a maximum allowable concentration of leaked gas in the duct system, wherein the control setpoint is from −2% to −6% of the lower flammability limit of the leaked gas as measured by the leak detection sensor, wherein after determining that the concentration falls within the control setpoint, the processor is configured to:

turn off the heating element; and initiate the blower to move the airflow through the duct system for a duration to reduce an amount of the leaked gas in the duct system.

8. A controller of a heating, ventilation, and air conditioning (HVAC) system, the controller comprising:

an interface communicatively coupled to:

a blower positioned in the duct system, the blower configured to move airflow across an indoor coil in the duct system;

a heating element positioned in the duct system, wherein the blower is further configured to move the airflow across the heating element to heat the airflow in the duct system, wherein the heating element is configured to receive a fuel from a fuel source, and wherein the heating element is configured to ignite the fuel to heat the heating element;

a leak detection sensor configured to measure at least one gas property value of the airflow in the duct system;

a memory having instructions for measuring the at least one gas property value of the airflow; and a processor communicatively coupled to the interface and the memory, the processor configured to:

measure a change in at least one gas property value of the airflow in the duct system using the leak detection sensor, wherein the change in the at least one gas property value is indicative of a gas leaked into the duct system;

determine a concentration of the leaked gas based at least in part upon the change in the at least one gas property value;

determine that the concentration as measured by the leak detection sensor has a negative value, wherein the negative value is indicative of the leaked gas comprising fuel from the heating element, wherein after determining that the concentration of the leaked gas has the negative value, the processor is configured to:

turn off the heating element; and initiate the blower to move the airflow through the duct system for a duration to reduce an amount of the leaked gas in the duct system.

9. The controller of claim 8, wherein the fuel comprises natural gas.

10. The controller of claim 8, wherein the processor is configured to: wherein after determining that the concentration of the leaked gas has a negative value, the processor is configured to trigger an alarm.

11. The controller of claim 8, wherein the at least one gas property value is selected from a speed of sound and thermal conductivity.

12. The controller of claim 8, wherein the processor is configured to:

measure a change in a speed of sound of the airflow in the duct system using the leak detection sensor, wherein the change in the speed of sound of the airflow is indicative of the leaked gas in the duct system;

determine a concentration of the leaked gas based on the change in the speed of sound, wherein the concentration is determined as a percentage of a lower flammability limit of the leaked gas;

compare the concentration to a control setpoint for a maximum allowable concentration of leaked gas in the duct system, wherein the control setpoint is from −1.5% to −4% of the lower flammability limit of the leaked gas as measured by the leak detection sensor, wherein after determining that the concentration falls within the control setpoint, the processor is configured to:

turn off the heating element; and initiate the blower to move the airflow through the duct system for a duration to reduce an amount of the leaked gas in the duct system.

13. The controller of claim 8, wherein the processor is configured to:

measure a change in a thermal conductivity of the airflow in the duct system using the leak detection sensor, wherein the change in the thermal conductivity of the airflow is indicative of the leaked gas in the duct system;

determine a concentration of the leaked gas based on the change in the speed of sound, wherein the concentration is determined as a percentage of a lower flammability limit of the leaked gas;

compare the concentration to a control setpoint for a maximum allowable concentration of leaked gas in the duct system, wherein the control setpoint is from −2% to −6% of the lower flammability limit of the leaked gas as measured by the leak detection sensor, wherein after determining that the concentration falls within the control setpoint, the processor is configured to:

turn off the heating element; and initiate the blower to move the airflow through the duct system for a duration to reduce an amount of the leaked gas in the duct system.

14. A method of operating a heating, ventilation, and air conditioning (HVAC) system configured to regulate a temperature of a space, the method comprising:

transferring heat between airflow in a duct system and a refrigerant in an indoor coil, wherein the indoor coil is positioned in the duct system, and wherein a blower is positioned in the duct system to move the airflow across the indoor coil;

transferring heat between the airflow in the duct system and a heating element in the duct system, wherein the blower is further configured to move the airflow across the heating element, wherein the heating element is configured to receive a fuel from a fuel source, and wherein the heating element is configured to ignite the fuel to heat the heating element;

measuring a change in at least one gas property value of the airflow in the duct system using a leak detection sensor positioned in the duct system, wherein the change in the at least one gas property value is indicative of a gas leaked into the duct system;

determining a concentration of the leaked gas based at least in part upon the change in the at least one gas property value;

determining that the concentration as measured by the leak detection sensor has a negative value, wherein the negative value is indicative of the leaked gas comprising fuel, wherein after determining that the concentration of the leaked gas has the negative value, turning off the heating element; and initiating the blower to move the airflow through the duct system for a duration to reduce an amount of the leaked gas in the duct system.

15. The method of claim 14, wherein the fuel comprises natural gas.

16. The method of claim 14, wherein the refrigerant comprises an A2L refrigerant.

17. The method of claim 14, wherein after determining that the concentration of the leaked gas has a negative value, the processor is configured to trigger an alarm.

18. The method of claim 14, wherein the at least one gas property value is selected from a speed of sound and thermal conductivity.

19. The method of claim 14 further comprising:

measuring a change in a speed of sound of the airflow in the duct system using the leak detection sensor, wherein the change in the speed of sound of the airflow is indicative of the leaked gas in the duct system;

determining a concentration of the leaked gas based on the change in the speed of sound, wherein the concentration is determined as a percentage of a lower flammability limit of the leaked gas;

comparing the concentration to a control setpoint for a maximum allowable concentration of leaked gas in the duct system, wherein the control setpoint is from −1.5% to −4% of the lower flammability limit of the leaked gas as measured by the leak detection sensor, wherein after determining that the concentration falls within the control setpoint, turning off the heating element; and initiating the blower to move the airflow through the duct system for a duration to reduce an amount of the leaked gas in the duct system.

20. The method of claim 14 further comprising:

measuring a change in a thermal conductivity of the airflow in the duct system using the leak detection sensor, wherein the change in the thermal conductivity of the airflow is indicative of the leaked gas in the duct system;

determining a concentration of the leaked gas based on the change in the speed of sound, wherein the concentration is determined as a percentage of a lower flammability limit of the leaked gas;

comparing the concentration to a control setpoint for a maximum allowable concentration of leaked gas in the duct system, wherein the control setpoint is from −2% to −6% of the lower flammability limit of the leaked gas as measured by the leak detection sensor, wherein after determining that the concentration falls within the control setpoint, turning off the heating element; and initiating the blower to move the airflow through the duct system for a duration to reduce an amount of the leaked gas in the duct system.

* * * * *